US006156260A

United States Patent [19]

Heaslip et al.

[11] Patent Number: 6,156,260

[45] **Date of Patent: *Dec. 5, 2000**

[54] CHAMBER FOR RECEPTION, LATERAL DIVISION AND REDIRECTION OF LIQUID METAL FLOW

[75] Inventors: Lawrence J. Heaslip; James D. Dorricott, both of Burlington, Canada

[73] Assignee: PSC Technologies, Inc., Carnegie, Pa.

[ * ] Notice: This patent is subject to a terminal disclaimer.

[21] Appl. No.: 09/328,838

[22] Filed: Jun. 9, 1999

Related U.S. Application Data

[63] Continuation of application No. 09/174,588, Oct. 19, 1998, abandoned, which is a continuation of application No. 08/839,038, Apr. 23, 1997, Pat. No. 5,861,121.

[60] Provisional application No. 60/031,348, Nov. 21, 1996.

[51] Int. Cl.[7] ..... C21B 7/12

[52] U.S. Cl. ..... 266/45; 266/229; 266/236; 266/275; 222/594

[58] Field of Search ..... 266/44, 45, 236, 266/275, 227, 229; 222/594, 590; 164/689, 437; 75/584

[56] References Cited

U.S. PATENT DOCUMENTS

| | | | |
|---|---|---|---|
| Re. 35,685 | 12/1997 | Schmidt et al. | 266/275 |
| 3,648,761 | 3/1972 | Speith et al. . | |
| 3,887,171 | 6/1975 | Neuhaus . | |
| 3,995,682 | 12/1976 | Fekete et al. . | |
| 4,715,586 | 12/1987 | Schmidt et al. . | |
| 4,776,570 | 10/1988 | Vo thanh et al. . | |
| 5,169,591 | 12/1992 | Schmidt et al. . | |
| 5,227,078 | 7/1993 | Augustine, III . | |
| 5,336,295 | 8/1994 | DeYoung et al. . | |
| 5,358,551 | 10/1994 | Saylor . | |
| 5,518,153 | 5/1996 | Zacharias et al. . | |
| 5,861,121 | 1/1999 | Heaslip et al. | 266/45 |

OTHER PUBLICATIONS

Isenberg–O'Louglin, "Dishing It Out, The Latest in Tundish Utensils and High–Tech Tableware" Metal Producing, pp. 23–25 and 78, Feb. 1996.

*Primary Examiner*—Scott Kastler

*Attorney, Agent, or Firm*—Ostrolenk, Faber, Gerb & Soffen, LLP

[57] ABSTRACT

A chamber for receiving a downward flow of liquid metal includes a generally horizontal base having a generally planar impact surface. A first faceted sidewall having a plurality of facets formed therein, generally extends upwardly from and encompasses the planar surface to define an interior space. The interior space has an upper opening for receiving the downward flow of liquid metal. A second wall extends inwardly and upwardly from the first faceted wall toward the upper opening. A plurality of buttresses are spaced along the first faceted wall. Each of the buttresses extends between the impact surface and the second faceted wall. The buttresses form a plurality of discrete pockets including at least one facet. The pockets are defined by the buttresses, the impact surface, the first faceted wall and the second wall. The buttresses laterally deflect and divide the radial outward flow into a plurality of discrete flow patterns associated with the plurality of pockets.

20 Claims, 4 Drawing Sheets

FIG.4
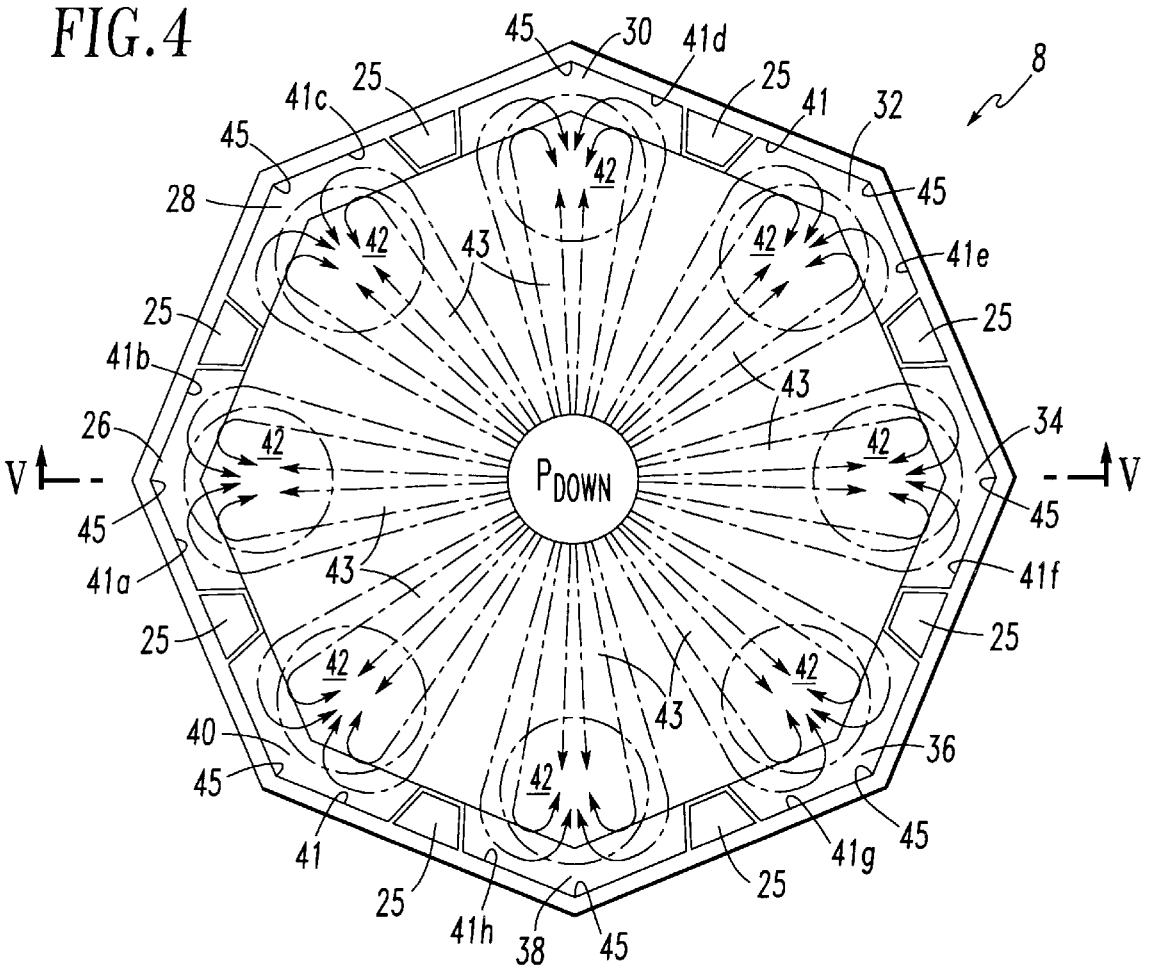
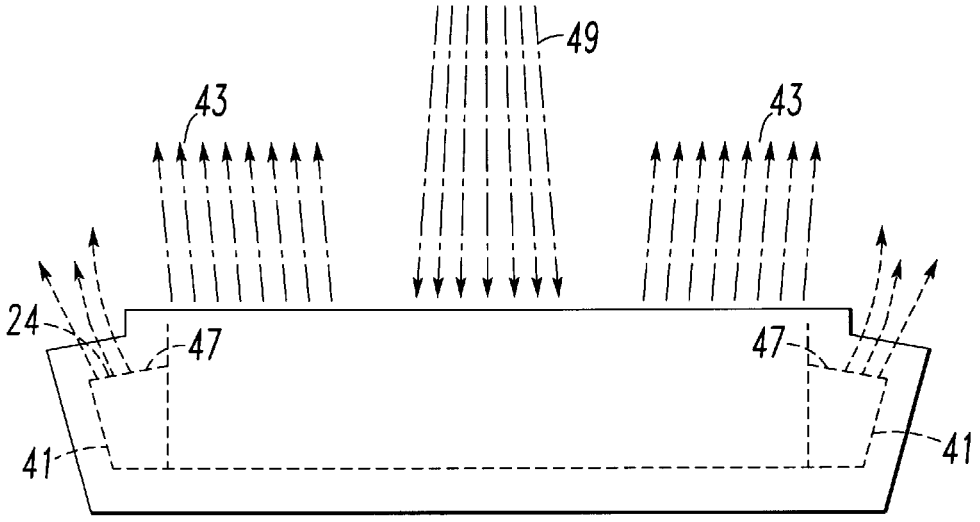
FIG.5

CHAMBER FOR RECEPTION, LATERAL DIVISION AND REDIRECTION OF LIQUID METAL FLOW

CROSS REFERENCE TO RELATED APPLICATIONS

This is a continuation of application Ser. No. 09/174,588, filed Oct. 19, 1998, now abandoned, which is a continuation of application Ser. No. 08/839,038, filed Apr. 23, 1997, now U.S. Pat. No. 5,861,121, which claims the benefit of U.S. Provisional Application No. 60/031,348 filed Nov. 21, 1996.

BACKGROUND OF THE INVENTION

1. Field of the Invention

The present invention relates to a tundish impact pad and more particularly to a tundish impact pad that stabilizes the flow of liquid metal exiting the pad.

2. Description of the Related Art

Liquid metal, and in particular liquid steel, is often poured from one vessel to another vessel. For example, liquid metal may be poured from a furnace into a ladle, and or from a ladle into a tundish, and or from a tundish into a mold. When liquid metal is poured into the tundish from the ladle, it is normally poured into the tundish through an outlet in the ladle bottom. The stream from the ladle is metered by a valve and the outlet stream may be enclosed in a ceramic tube, called a ladle shroud, which is connected to the valve.

A typical tundish has a simple design consisting of either a trough or box shaped vessel having a generally horizontal or flat bottom with vertically arranged walls. In these designs, the stream pouring from the ladle, i.e. incoming ladle stream or flow, enters the tundish, impacts the tundish bottom, and spreads in all directions. A flat impact pad is commonly used on the tundish bottom in the impact area pad to reduce erosion of the tundish refractory lining.

After the incoming flow is spread, a portion of the incoming flow rises up the vertical walls of the tundish, travels back along the surface of the liquid steel toward the ladle stream inlet location, and is re-entrained within the incoming flow of the ladle stream or flow. Another portion of the flow does not directly impact the tundish vertical walls and is dispersed throughout the tundish volume.

The aforementioned flow patterns result in many problems. The problems encountered with the above described flow pattern include:

1. Non-separation of slag and inclusion particles. The turbulence introduced by the incoming ladle stream or flow and the pattern of liquid metal flow generated within the tundish does not allow the separation by flotation of buoyant slag and inclusion particles entrained within the liquid metal and can actually cause slag to be re-entrained.

2. Smooth flow disturbance. Turbulence within the tundish caused by the dissipation of the kinetic energy of the ladle stream is propagated above adjacent tundish nozzles and this energy disturbs the smooth flow which is required to properly fill the molds.

3. Thermal inhomogeneity. Short-circuit flow and different liquid metal residence time behavior associated with each tundish to mold stream results in thermal inhomogeneity of the liquid metal contained in the tundish. Tundish exit streams therefore experience different temperatures, with colder metal exiting the tundish furthest from the ladle stream and hotter metal exiting the tundish closest to the ladle stream.

Tundish impact pads having complex geometries have been proposed to alleviate the above problems, but without success. Examples of these pads are disclosed in U.S. Pat. No. 5,169,591 (the "'591 patent") and U.S. Pat. No. 5,358,551 (the "'551 patent"). Both of these patents describe impact pads which contain the inlet flow from the ladle. This is not unique since flow from a ladle has been contained within many different impact pad designs for many years. Moreover, the existence of a continuous wall around a pad with upward release of the flow has been practiced in many designs prior to the existence of the aforementioned patents.

The '551 and '591 patents teach a reversal of the flow generated by the incoming ladle stream. One of the many problems with these pad designs is that they do not address the very real issue of what happens to the flow when the incoming stream is not directed at the exact geometric center of the pad. This is the normal state of affairs in a tundish as the ladle stream moves in practice as the ladle valve compensates for the changing head pressure in the ladle. A non-central location of the incoming ladle stream causes an amplification of the reversed flow and can result in excessive splash or ultimately, liquid metal being ejected from the tundish.

Another problem with these pad designs is that the flow is directed from the pad in an inward and upward manner. This inward and upward flow accelerates the flow and causes it to "rebound" off the surface of the liquid metal in the tundish, causing short-circuit flow to the closer tundish exit strands.

Thus, none of the prior art pads effectively eliminate the aforementioned problems and furthermore, can exacerbate problems associated with slag emulsification, flow stagnation regions, thermal inhomogeneity, shortcircuit flow, liquid residence distribution, and in particular, initial splash when the ladle is first opened.

SUMMARY OF THE INVENTION

Accordingly, it is an object of the present invention to provide an impact pad that stabilizes the flow of liquid metal exiting the pad.

Another object is to provide such an impact pad to control the radially dispersed outward flow which is formed by the impact of the downward ladle stream on the base of the pad.

A further object is to provide such an impact pad to control the radially dispersed outward flow by multiple faceting and discrete pocketing of the pad's sidewall.

It is also an object to provide such an impact pad to control the radially dispersed outward flow by laterally deflecting and dividing the radial flow into multiple discrete, stable and consistent flow patterns or segments associated with each of the sidewall pockets.

It is another object to provide such an impact pad that is insensitive to the ladle pouring stream.

It is a further object to provide such an impact pad to eliminate problems associated with slag emulsification, flow stagnation regions, thermal inhomogeneity, short-circuit flow, liquid residence distribution, and in particular, initial splash when the ladle is first opened.

It is still a further object to provide such an impact pad that is easy to use and manufacture.

It has been found that the above and other objects of the present invention are attained in a chamber for receiving a downward flow of liquid metal. The chamber includes a generally horizontal base having a generally planar impact surface. A first faceted sidewall having a plurality of facets formed therein, generally extends upwardly from and encompasses the planar surface to define an interior space.

The interior space has an upper opening for receiving the downward flow of liquid metal. A second wall extends inwardly and upwardly from the first faceted wall toward the upper opening.

A plurality of buttresses or flow dividers are spaced along the first faceted wall. Each of the buttresses extend between the impact surface and the second faceted wall. The buttresses form a plurality of discrete pockets including at least one facet. The pockets are defined by the buttresses, the impact surface, the first faceted wall and the second wall. Preferably, the buttresses laterally deflect and divide the radial outward flow into a plurality of discrete flow patterns associated with the plurality of pockets.

In a preferred embodiment, the buttresses laterally deflect the flow patterns towards the facets and the discrete flow patterns are directed out of the interior space in an upwardly and outwardly direction away from the downward flow of liquid metal.

Preferably, the pad includes a third wall defining the upper opening of the interior space. The third wall extends generally upwardly from the second wall.

In a preferred embodiment, the first faceted wall is outwardly and upwardly angled at an angle greater than about 90° from the planar impact surface.

Preferably, the second wall extends from the first faceted wall at an angle of about 45 to 135°, and more preferably, at an angle of about 90°.

In a preferred embodiment, the third wall extends from the second wall at an angle of about 45 to 150°. Preferably, the third wall extends from the second wall at an angle of about 125°.

Other features and advantages of the present invention will become apparent from the following description of the invention which refers to the accompanying drawings.

BRIEF DESCRIPTION OF THE DRAWING(S)

For the purpose of illustrating the invention, there is shown in the drawings an embodiment which is presently preferred; it being understood, however, that the invention is not limited to the precise arrangements and instrumentalities shown.

FIG. 1 is a top plan view of an impact pad of the present invention.

FIG. 1*a* is a side sectional view of the impact pad of FIG. 1.

FIG. 2 is a top plan view of an alternative embodiment of the impact pad of the present invention. (Buttresses not shown in background for clarity).

FIG. 2*a* is a side sectional view of the impact pad of FIG. 2. (Buttresses not shown in background for clarity).

FIG. 3 is a top plan view of an alternative embodiment of the impact pad of the present invention.

FIG. 3*a* is a side-sectional view of the impact pad of FIG. 3.

FIG. 3*b* is another side-sectional view of the impact pad of FIG. 3.

FIG. 4 is a schematic representation of the flow of liquid metal in the interior region of the impact pad of the present invention.

FIG. 5 is a schematic representation of the flow of liquid metal into and out of the impact pad of FIG. 4 taken along line A—A of FIG. 4.

DETAILED DESCRIPTION OF EMBODIMENTS OF THE INVENTION

The impact pad of the present invention is a tundish impact pad that receives a stream of liquid metal falling from a ladle into a tundish. The pad radially spreads, then laterally deflects (or reflects) and divides the radial outward flow which is formed by the impact of the downward ladle stream on the base of the pad. The radial outward flow is deflected and divided into multiple discrete, stable and consistent flow patterns or segments. Subsequently, the flow is redirected upwardly and outwardly out of the chamber to the remainder of the tundish volume in a manner which promotes a more homogeneous temperature distribution, promotes an upwardly flow for the flotation of inclusions and entrained slag, and eliminates splash when the tundish level is below the height of the chamber.

Figure 1:
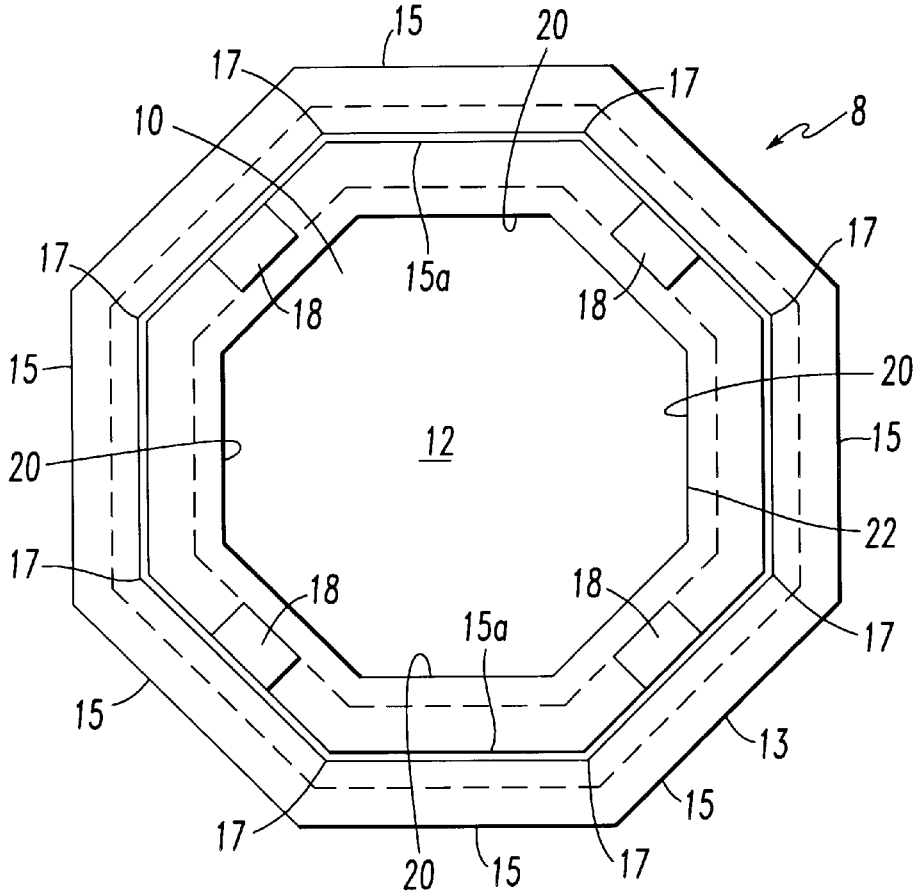
Figure 1A:
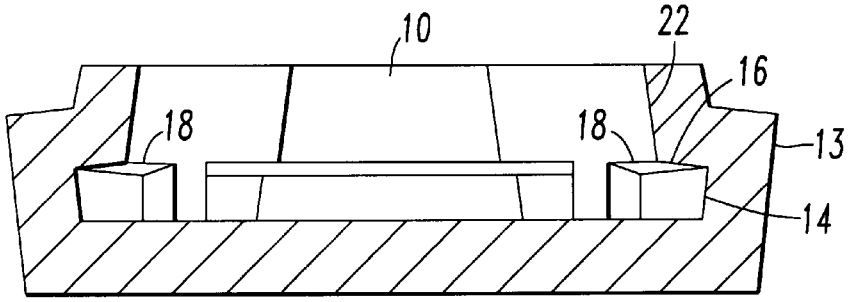

Referring now to the drawings wherein like numerals indicate like elements, there is shown in FIG. 1 an impact pad 8 of the present invention. The impact pad 8 is different and unique in its design. As a result, the design produces a different and unique effect upon the fluid flow of the liquid metal.

The impact pad 8 includes an inner chamber 10 for receiving a downward flow of liquid metal. The chamber 10 includes a generally horizontal or planar bottom wall 12 where the flow is spread radially. The bottom wall 12 may be flat or contoured or textured, i.e., it may include a landscape of various shapes and/or reliefs. For example, the bottom wall 12 may include one or more ripples or humps formed therein.

The bottom wall 12 is fully surmounted and surrounded by an outer endless multi-faceted sidewall 13 including facets 15 and an inner multi-faceted sidewall 14 including facets 15*a*. Due to the buttresses or flow dividers 18 discussed below, and the discrete pocketing formed by the buttresses, the inner sidewall 14 does not include a continuous or endless wall or annulus. Stated otherwise, the inner sidewall 14 is not continuous.

The inner sidewall 14 should have a plurality of facets 15*a*. Located at the intersection of facets 15*a* are corners or apices 17. Preferably, there should be at least 4–10 facets and more preferably eight (8) facets. It should be appreciated by those skilled in the art that the outer sidewall 13 need not be faceted.

The first faceted wall 14 is outwardly and upwardly angled at an angle greater than about 90° from the horizontal, i.e. bottom wall, and preferably at an angle between about 90 and 120°.

A second faceted internal wall 16 meets the top of the first faceted wall 14 at an angle between those walls of about 90°, but at least in the range between about 45–135°. The second faceted wall 14 extends upwardly and inwardly towards the chamber 10.

At approximately the midpoint of four (4) facets 15*a* of the first faceted wall 14, and adjoining all of the bottom wall 12, the first faceted wall 14, and the second faceted wall 16, are four (4) flow deflectors or flow dividers or buttresses 18 that project into the chamber 10 from all of the walls 12, 14 and 16. It should be appreciated by those skilled in the art that the buttresses 18 can be any size or shape just so long as the buttresses laterally deflect and/or divide the radially outward flow into a plurality of discrete, consistent flow patterns.

The impact pad 8 should include a plurality of buttresses 18. Preferably, the impact pad 8 should include about 4–10 buttresses, and more preferably about eight (8) buttresses located at approximately the midpoint of all eight (8) segments 15*a* is of the first faceted wall 14. See FIG. 4.

The buttresses 18 divide the chamber 10 into four (4) discrete pockets 20. Each of the pockets 20 should include at least one apex 17. Preferably, there should be enough buttresses to divide the chamber 10 into a plurality of discrete pockets 20, preferably about 4–10 pockets 20. For example, in a preferred embodiment, the impact pad should have eight (8) buttresses dividing the chamber into eight (8) discrete pockets, FIG. 4.

The pockets 20 are where the radial flow is laterally divided, stabilized and more consistently directed into the apices 17. In practice, in each of the pockets 20, the radial flow first is divided deflected laterally into the apices 17 by buttresses 18 and facets 15*a*. This flow is then directed upwardly toward the second faceted wall 16. The flow is then directed out of the impact pad 8 in an upwardly and outwardly direction away from the center of the chamber 10.

A third faceted wall 22 meets the top of the second faceted wall 16 at an angle between those walls typically about 125°, but could range from about 110–150°. The angle of the third faceted wall 22 defines the final upper release space for the second upwardly and outwardly flow caused by the second faceted wall 16. It should be appreciated by those skilled in the art that the second and third faceted walls 16, 22 need not be faceted.

Figure 2:
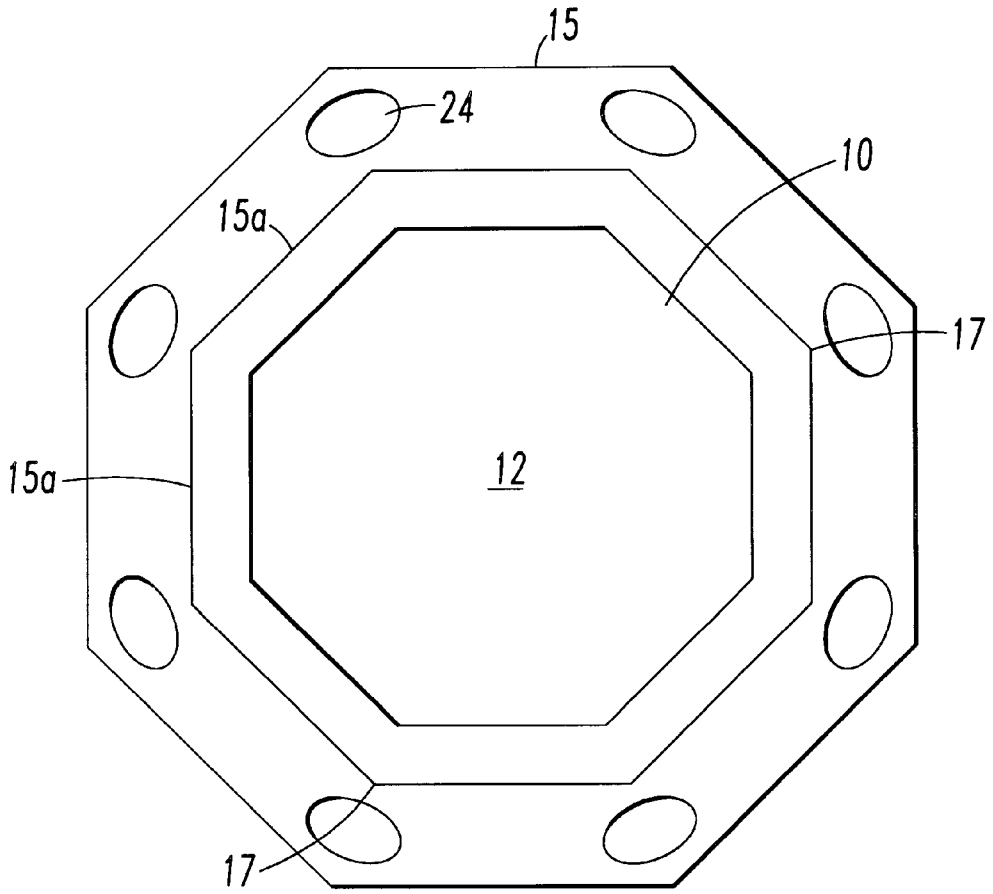
Figure 2A:
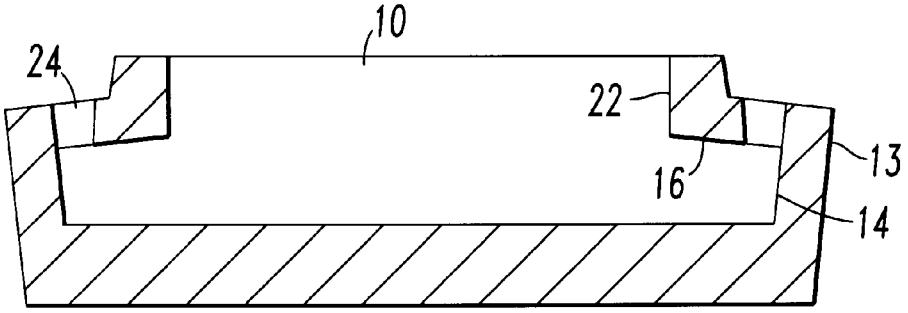

Referring now to FIGS. 2, 2*a*, in an alternative embodiment the second faceted wall 16 may include outlet ports 24. The outlet ports 24 release the first upwardly flow caused by the first faceted wall 14 from the pad in an upwardly and outwardly direction. In FIG. 2*a* the buttresses are not shown for clarity.

Figure 3:
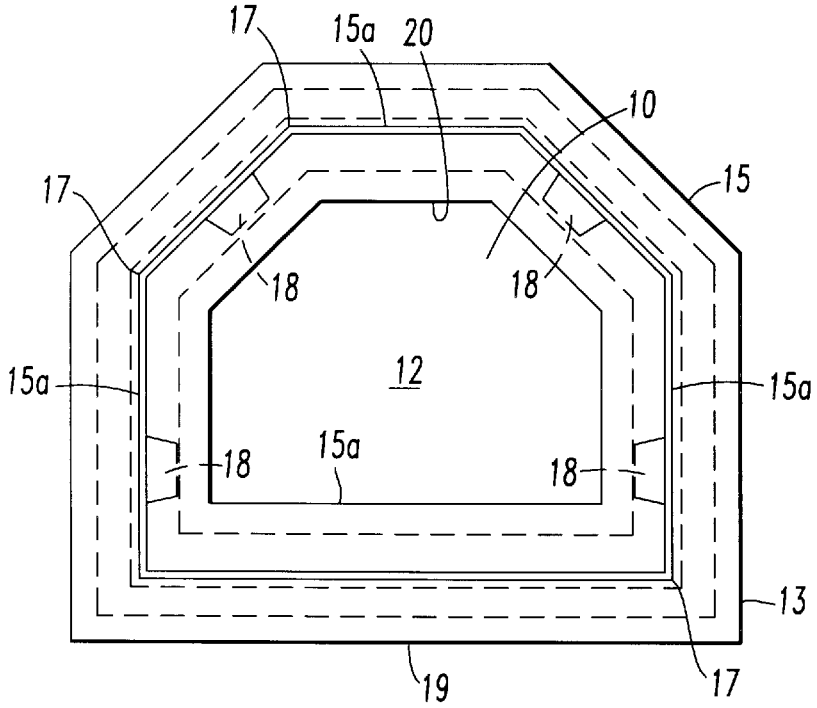
Figure 3A:
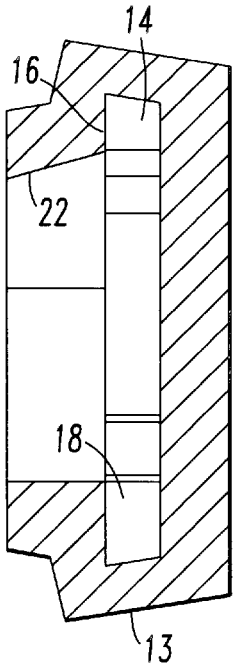
Figure 3B:
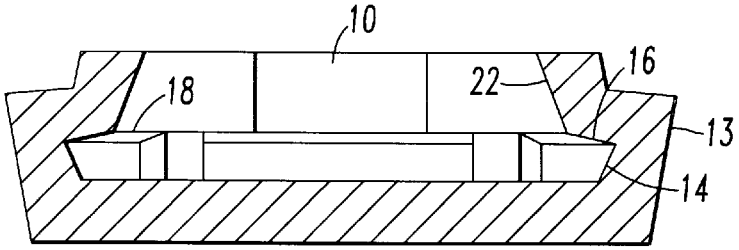

Referring now to FIGS. 3, 3*a*, 3*b*, these figures show an alternative embodiment of the present invention suitable for tundish designs where, for example, the ladle pouring position causes the downward stream to impact the tundish near the tundish sidewall. In that case, the segment 19 of the outer wall 13 would rest against the inner wall of the tundish, now shown.

Referring now to FIGS. 4 and 5, these figures show a schematic representation of the flow behavior when looking down on the preferred embodiment 8-faceted (or octagonal) impact pad 8. The pad 8 includes eight facets 41*a–h*, and eight sidewall pocket regions 26,28,30,32,34,36,38 and 40, respectively, formed by eight (8) buttresses 25. Each of the pocket regions includes at least one apex 45. In FIG. 5, the buttresses 25 are not shown for clarity.

It should be realized by those skilled in the art that the impact pad of the present invention need not take on any particular shape or geometry. The impact pad 8 of the present need not take on any particular shape or geometry just so long as the buttresses 18 divide the chamber into the number of pockets, and include the number of facets, described above. In fact, it is contemplated that the impact pad of the present invention can take on a variety of shapes and geometries to accommodate the shape and geometry of any given vessel, e.g., tundish, and to accommodate various ladle pouring positions, e.g., off-center pouring positions as discussed above with respect to FIG. 3.

The impact pad 8 laterally deflects and divides the radially outward flow by the multiple faceting (i.e., eight facets 41*a,b,c,d,e,f,g* and *h* and discrete pocket regions 26,28,30, 32,34,36,38 and 40 of the inner sidewall 41. This has the effect of dividing the radial outward flow into multiple discrete, consistent flow patterns 43 (eight (8) in the case of FIG. 4) each associated with a sidewall pocket 26–40.

Dividing the flow into eight (8) discrete flow patterns 43 each associated with a respective pocket region 26,28,30, 32,34,36,38, and 40 has a stabilizing influence on the flow behavior. The 3-dimensional flow patterns which are formed within the pad are illustrated with arrows in FIG. 4. The central region labeled $P_{down}$ is the region where the dynamic pressure of the incoming stream 49 is greatest and downwardly directed. The eight (8) regions 42 which are adjacent to the apices 45 of the pad are the regions where the upward dynamic pressure or force is greatest.

After the incoming stream 49 impacts the base of the pad in the central region labeled $P_{down}$, the flow spreads radially outward until it contacts the buttresses 25 which laterally deflect and divide the radial outward flow into the eight (8) discrete flow patterns 43 associated with the pocket regions 28, 30, 32, 34, 36, 38 and 40. Once the flow is divided within each of the pocket regions 28, 30, 32, 34, 36, 38 and 40, the separate or divided flows 43 are directed or deflected by buttresses 25 and facets 41*a–h* toward the respective apices 45. The flow is then directed upwardly and outwardly toward the second faceted wall 47. The second faceted wall 47 then diverts the separate flows 43 toward the regions 42 adjacent the apices 45 where the upward dynamic pressure or force is greatest.

The separate flows 43 then exit the pad at the regions 42 in an upwardly and outwardly direction away from the incoming flow 49 as shown in FIG. 5. The outgoing flow at regions 42 and the incoming flow 49 at region $P_{down}$ do not overlap, (i.e. they do not strike each other, interfere or cancel their respective oppositely directed forces) nor do they slow each other down. If the second faceted wall 47 includes outlet ports 24, at least part of the upwardly and outwardly flow from the first faceted wall 41 would also be directed out of the pad in a upwardly and outwardly direction through the outlet ports 24.

By utilizing lateral deflection of the flow from the ladle, instead of, for example, flow reversal as taught by prior impact pads, the impact pad of the present invention provides many benefits. These benefits are:

1. Flow stabilization. Dividing and laterally deflecting the radial flow within the discrete pockets produces a much more stable flow exiting the pad. In addition, flow stabilization as a result of the buttresses, and controlling the area of the outlet holes provides sufficient velocity and controlled flow redirection so that the fluid residence time behavior within the tundish is complimented. A relationship between the total casting rate in lbs/min., the volume in the chamber (cubic inches), and the outlet hole(s) area (square inches) can be determined on the basis of the desired turbulence energy factor.

2. Insensitivity to the ladle pouring position. Dividing and laterally deflecting the flow within the discrete pockets eliminates the initial splash associated with the first ladle opening because the flow within the impact chamber pad is not sensitive to the ladle pouring position. In prior art pads, a non-central location of the incoming ladle stream amplifies the reversed flow and can result in excessive splash or ultimately, liquid metal being ejected from the tundish. In the case of the impact pad of the present invention, the lateral deflection and flow pattern division stabilizes the flow so that even under non-central ladle pouring conditions, high velocity jetting and resulting turbulence are alleviated.

3. No short-circuit flow. In prior art pads, the flow is directed from the pad in an upward and inward direction which accelerates the flow and causes it to "rebound" off the surface of the liquid metal in the tundish, causing short-circuit flow to the closest exit strands in the tundish. In the impact pad of the present invention, the chamber releases the flow in an upward and outward manner which alleviates this type of short-circuit flow.

4. Cleanliness. The upward and outward flow from the impact pad of the present invention provides continual opportunity for the floatation of slag and nonmetallic inclusions, resulting in liquid metal cleanliness improvements, particularly when the tundish is being filled or refilled. Moreover, the impact pad prevents the radial outward flow from being re-entrained with the incoming ladle stream.

In summary, the impact pad of the present invention stabilizes the flow of liquid metal exiting the pad. It controls the radially dispersed outward flow which is formed by the impact of the downward ladle stream on the base of the pad.

The impact pad controls the radially dispersed outward flow by the multiple faceting and discrete pocketing of the pad's sidewall. The sidewall pockets radially disperse the outward flow by laterally deflecting and dividing the radial flow into multiple discrete, stable and consistent flow patterns or segments associated with each of the sidewall pockets.

The impact pad of the present invention is insensitive to the ladle pouring stream. It eliminates problems associated with slag emulsification, flow stagnation regions, thermal inhomogeneity, short-circuit flow, liquid residence distribution, and in particular, initial splash when the ladle is first opened. And the impact pad is easy to use and manufacture.

Although the present invention has been described in relation to particular embodiments thereof, many other variations and modifications and other uses will become apparent to those skilled in the art.

What is claimed is:

1. A chamber for receiving a flow of liquid metal comprising;

a base having a generally planar impact surface;

a first wall coupled to a periphery of the planar surface and defining an interior space having an opening for receiving the flow of liquid metal;

a second wall extending inwardly and upwardly from the first wall, the base, first wall and second wall defining a liquid metal stream reduction region; and a plurality of buttresses positioned within the liquid metal stream reduction region, each of the buttresses extending between the first wall, the impact surface and the second wall, the buttresses defining a plurality of discrete pockets within said liquid metal stream reduction region.

2. The chamber of claim 1, whereby the chamber is constructed and arranged so that when the flow of liquid metal impacts the impact surface, the flow is spread radially outwardly toward the buttresses, which laterally deflect and divide the radial outward flow into a plurality of discrete flow patterns associated with the plurality of pockets.

3. The chamber of claim 1, wherein the first wall has a plurality of facets.

4. The chamber of claim 2, wherein the discrete flow patterns are directed out of the interior space in an upwardly and outwardly direction away from the downward flow of liquid metal.

5. The chamber of claim 1, including a third wall defining the upper opening of the interior space, the third wall extending generally upwardly from the second wall.

6. The chamber of claim 1, wherein the first wall is outwardly and upwardly angled at an angle greater than about 90° from the planar impact surface.

7. The chamber of claim 6, wherein the first wall is angled at an angle between about 90 and 120° from the planar impact surface.

8. The chamber of claim 1, wherein the second wall extends from the first wall at an angle of about 45 to 135°.

9. The chamber of claim 8, wherein the second wall extends from the first wall at an angle of about 90°.

10. The chamber of claim 5, wherein the third wall extends from the second wall at an angle of about 45 to 150°.

11. The chamber of claim 10, wherein the third wall extends from the second wall at an angle of about 125°.

12. The chamber of claim 3, wherein the first wall includes 4–10 facets.

13. The chamber of claim 12, wherein the first wall includes eight facets.

14. The chamber of claim 1, wherein the interior space includes 4–10 pockets.

15. The chamber of claim 14, wherein the interior space includes eight pockets.

16. The chamber of claim 1, wherein the first wall includes 4–10 buttresses.

17. The chamber of claim 16, wherein the first wall includes eight buttresses.

18. The chamber of claim 13, wherein the first faceted wall includes about eight buttresses forming about eight discrete pockets, each of the pockets including at least one facet.

19. A method for receiving, laterally dividing and redirecting a flow of liquid metal comprising;

receiving a flow of liquid metal in a chamber having a base including a generally planar impact surface, and a first faceted wall coupled to a periphery of the planar impact surface to define an interior space having an opening;

radially spreading the flow outwardly towards the first wall;

laterally deflecting and dividing the radial outward flow into a plurality of discrete flow patterns; and directing the flow patterns towards the apices of the facets.

20. The method of claim 19, further comprising the step of redirecting the flow patterns out of the opening in a direction away from the incoming flow of liquid metal.

* * * * *